US011390075B2

(12) United States Patent
Choy et al.

(10) Patent No.: US 11,390,075 B2
(45) Date of Patent: Jul. 19, 2022

(54) FLUIDIC DIES

(71) Applicant: HEWLETT-PACKARD DEVELOPMENT COMPANY, L.P., Spring, TX (US)

(72) Inventors: Si-lam Choy, Corvallis, OR (US); Chien-Hua Chen, Corvallis, OR (US); Michael W Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/634,926

(22) PCT Filed: Sep. 20, 2017

(86) PCT No.: PCT/US2017/052519
§ 371 (c)(1),
(2) Date: Jan. 29, 2020

(87) PCT Pub. No.: WO2019/059905
PCT Pub. Date: Mar. 28, 2019

(65) Prior Publication Data

US 2020/0238699 A1 Jul. 30, 2020

(51) Int. Cl.
*B41J 2/14* (2006.01)
*B41J 2/175* (2006.01)

(52) U.S. Cl.
CPC ..... *B41J 2/14145* (2013.01); *B41J 2/14201* (2013.01); *B41J 2/175* (2013.01); *B41J 2002/14419* (2013.01)

(58) Field of Classification Search
CPC ..... B41J 2/18; B41J 2202/12
See application file for complete search history.

(56) References Cited

U.S. PATENT DOCUMENTS

| | | | | |
|---|---|---|---|---|
| 5,017,941 | A | 5/1991 | Drake | |
| 5,760,804 | A | 2/1998 | Heinzl et al. | |
| 6,055,002 | A | 4/2000 | Wen et al. | |
| 6,343,857 | B1 * | 2/2002 | Cowger | B41J 2/1408 347/89 |
| 6,364,466 | B1 | 4/2002 | Chen et al. | |

(Continued)

FOREIGN PATENT DOCUMENTS

| | | |
|---|---|---|
| CN | 102186675 | 9/2011 |
| CN | 102481789 | 5/2012 |

(Continued)

OTHER PUBLICATIONS

Through-channel Ink Recirculation, http://www.iacs.be/through-channel-ink-recirculation.html.

*Primary Examiner* — Shelby L Fidler
(74) *Attorney, Agent, or Firm* — Fabian VanCott

(57) ABSTRACT

A fluidic die includes a fluid channel layer including at least one fluid channel defined along a length of the fluid ejection device. The fluidic die also includes an interposer layer coupled to the fluid channel layer. The interposer layer includes a number of inlet ports defined in the interposer layer to fluidically couple the at least one channel layer to a fluid source, and a number of outlet ports defined in the interposer layer to fluidically couple the at least one channel layer to the fluid source.

20 Claims, 7 Drawing Sheets

(56) References Cited

U.S. PATENT DOCUMENTS

| | | | | |
|---|---|---|---|---|
| 6,880,926 | B2 * | 4/2005 | Childs | B41J 2/14145 347/89 |
| 8,033,643 | B2 | 11/2011 | Chen et al. | |
| 9,162,453 | B2 | 10/2015 | Cruz-Uribe et al. | |
| 2008/0180490 | A1 | 7/2008 | Murata | |
| 2010/0208010 | A1 * | 8/2010 | Inoue | B41J 2/14145 347/85 |
| 2013/0182022 | A1 * | 7/2013 | Strunk | B41J 2/17596 347/6 |
| 2014/0327720 | A1 * | 11/2014 | Choy | B41J 2/14145 347/47 |
| 2016/0023461 | A1 | 1/2016 | Chen et al. | |
| 2017/0197416 | A1 * | 7/2017 | Moriya | B41J 2/18 |
| 2017/0197420 | A1 * | 7/2017 | Okushima | B41J 2/14145 |
| 2019/0001699 | A1 * | 1/2019 | Nakakubo | B41J 2/17596 |

FOREIGN PATENT DOCUMENTS

| | | | |
|---|---|---|---|
| CN | 105142910 | | 12/2015 |
| EP | 2825386 | | 1/2015 |
| JP | 2002192723 | | 7/2002 |
| JP | 2013501655 | | 1/2013 |
| JP | 2013532594 | | 8/2013 |
| JP | 2015180551 | | 10/2015 |
| JP | 2016508460 | | 3/2016 |
| JP | 2017001247 | | 1/2017 |
| JP | 2017124615 | | 7/2017 |
| JP | 2017144634 | | 8/2017 |
| WO | WO-2011005699 | | 1/2011 |
| WO | WO-2013002775 | A1 | 1/2013 |
| WO | WO-2013048382 | A1 | 4/2013 |
| WO | WO-2016137490 | | 9/2016 |

* cited by examiner

FLUIDIC DIES

BACKGROUND

A fluid ejection die in a fluid cartridge or print bar may include a plurality of fluid ejection elements on a surface of a silicon substrate. By activating the fluid ejection elements, fluids may be printed on substrates. The fluid ejection die may include resistive or piezoelectric elements used to cause fluid to be ejected from the fluid ejection die. The fluids are caused to flow to the fluid ejection elements through slots and channels that are fluidically coupled to chambers in which the fluid ejection elements reside.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
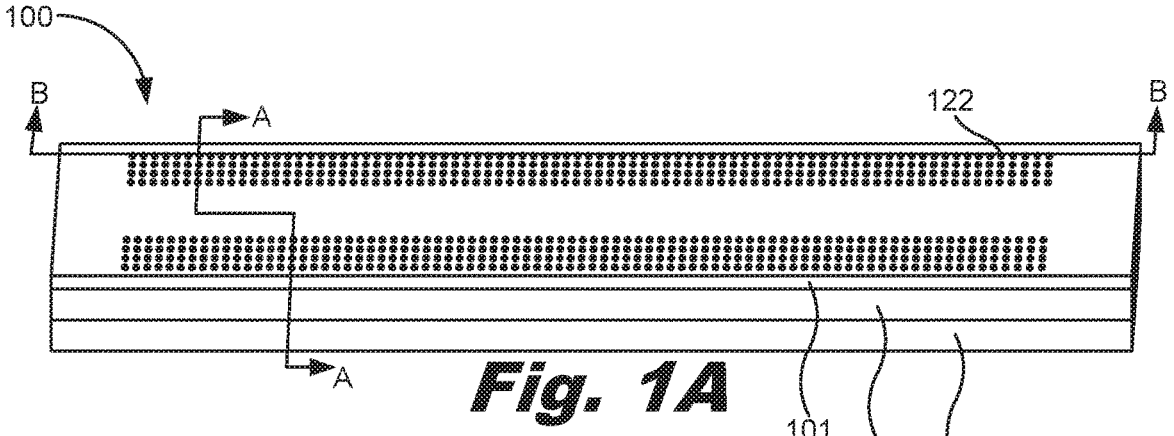
FIG. 1A is a perspective view of a fluid flow structure, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

The fluids used in printing may include inks and other fluids that contain pigments. Fluids that include pigments may suffer from pigment settling. Pigments may be insoluble in a printable fluid such as an ink vehicle, and may form discrete particles that clump or agglomerate if they are not stabilized in the printable fluid. Pigment settling rates may be due to differences in pigment size, density, shape, or degree of flocculation. To prevent the pigments from agglomerating or settling out of the printable fluid, the pigments may be uniformly dispersed in the printable fluid and stabilized in the dispersed form until the printable fluid is used for printing. The pigment may be present in the printable fluid in a distribution of particle sizes, which may be selected based on performance attributes, such as stability, gloss, and optical density ("OD"), among others.

Further, with pigment settling, decapping may be used to ensure that the printable fluid with its pigments are ready to print without creating undesirable print errors. Pigment settling causes clogging of nozzles through which the fluid ejection elements eject the printable fluid, resulting in less than optimal printing performance including, for example, a print swath having less than optimum height. If this pigment settling is not catastrophic, the nozzles may be recovered by successive steps of pen servicing in the associated printing device in the form of a decapping process. However, while the decapping process may be used to ensure that the ejection of the printable fluid occurs as intended, it takes time to perform such a process, and slows down the production of a printed product.

Micro-recirculation of the printable fluid may be used to ensure that pigment settling and subsequent capping of the nozzles does not occur or is mitigated. Micro-recirculation processes include forming a number of micro-recirculation channels within or adjacent to the firing chambers, fluid ejection elements, and nozzles of a printhead. A number of external and/or internal pumps may be used to move the printable fluid through the micro-recirculation channels. The micro-recirculation channels serve as by-pass fluidic paths, and along with the internal and external pumps, recirculate the printable fluid through the firing chambers. However, waste heat generated by the micro-recirculation pumps, which may take the form of resistive elements, stays in the printable fluid, and increases the temperature of the printhead die including, for example, silicon layers within the printhead die. This increase of temperature creates user-perceptible thermal defects within printed media. This may limit the wide use of micro-recirculation and its benefit of reducing or eliminating pigment settling and capping of nozzles.

Although some printhead and printhead die architectures are able to maintain low operating temperatures, waste heat from the micro-recirculation system including its internal resistor-based pumps may increase the waste heat above a desired operating temperature. Further, in some printhead and printhead die architectures, macro-, meso-, and micro-recirculation system designs may place micro-channels too far from a fluid feed hole (e.g., and ink feed hole (IFH)), the firing chambers, the fluid ejection elements, the nozzles, or combinations thereof to effectively cool the die.

Examples described herein provide a fluidic die that includes a fluid channel layer including at least one fluid channel defined along a length of the fluidic die. The fluidic die also includes an interposer layer coupled to the fluid channel layer. The interposer layer includes a number of inlet ports defined in the interposer layer to fluidically couple the at least one channel layer to a fluid source, and a number of outlet ports defined in the interposer layer to fluidically couple the at least one channel layer to the fluid source.

The number of inlet ports and outlet ports defined in the interposer layer may be based on a minimum flow path. The minimum flow path may be defined by the number of inlet ports and outlet ports defined in the interposer layer to increase uniformity of fluid flow within the fluid channel layer.

The fluidic die may include a carrier substrate coupled to the interposer layer. The carrier substrate may include a number of apertures defined therein corresponding to the inlet ports and outlet ports.

The fluidic die may also include a number of microfluidic pumps disposed within the fluid feed holes. Further, flow of a fluid within the at least one fluid channel may be perpendicular relative to the flow of the fluid within the inlet ports and outlet ports. The fluidic die may be a fluid ejection device including a fluid ejection die to eject fluid from the fluid ejection device. The fluid channel layer may be fluidically coupled to the fluid ejection die via a number of fluid feed holes defined within the fluid ejection die. Further, at least a portion of the fluid ejection device may be overmolded within a moldable material.

Examples described herein also provide a system for recirculating fluid within a fluidic die. The system may include a fluid reservoir, and a fluidic die fluidically coupled to the fluid reservoir. The fluidic die may include a fluid channel layer. The fluid channel layer may include at least one fluid channel defined along a length of the fluidic die, and an interposer layer coupled to the fluid channel layer. The interposer layer may include a number of inlet ports defined in the interposer layer to fluidically couple the at least one channel layer to a fluid source, and a number of outlet ports defined in the interposer layer to fluidically couple the at least one channel layer to the fluid source. The system may further include an external pump fluidically coupled to the fluid reservoir and the fluidic die to exert a pressure difference sufficient to move a fluid through the inlet ports and outlet ports.

The fluid ejection die may include a fluid ejection die fluidically coupled to the fluid channel layer via a number of fluid feed holes defined within the fluid ejection die. The fluid ejection die may include a number of nozzles, and an array of fluid firing chambers fluidically coupled to the nozzles to eject fluid through the nozzles. The number of fluid feed holes are fluidically coupled to the array of firing chambers.

The system may include a carrier substrate coupled to the interposer layer. The carrier substrate may include a number of apertures defined therein corresponding to the inlet ports and outlet ports. Further, at least a portion of the fluid ejection device may be overmolded within a moldable material.

Examples described herein also provide a fluid flow structure. The fluid flow structure may include a fluid channel layer including at least one fluid channel defined along a length of the fluid ejection device. The fluid flow structure may also include an interposer layer coupled to the fluid channel layer. The interposer layer may include a number of inlet ports defined in the interposer layer to fluidically couple the at least one channel layer to a fluid source, and a number of outlet ports defined in the interposer layer to fluidically couple the at least one channel layer to the fluid source.

The fluid flow structure may also include a carrier substrate coupled to the interposer layer, the carrier substrate comprising a number of apertures defined therein corresponding to the inlet ports and outlet ports. The number of inlet ports and outlet ports defined in the interposer layer may be based on a minimum flow path. The minimum flow path may be defined by the number of inlet ports and outlet ports defined in the interposer layer to increase uniformity of fluid flow within the fluid channel layer. Further, in one example, the fluid channel layer and interposer layer of the fluid flow structure may be compression molded into a moldable material.

As used in the present specification and in the appended claims, the term "actuator" refers any device that ejects fluid from a nozzle or any other non-ejecting actuator. For example, an actuator, which operates to eject fluid from the nozzles of a fluid ejection die may be, for example, a resistor that creates cavitation bubbles to eject the fluid or a piezoelectric actuator that forces fluid from the nozzles of a fluid ejection die. A recirculation pump, which is an example of a non-ejecting actuator, moves fluid through passages, channels, and other pathways within the fluid ejection die, and may be any resistive device, piezoelectric device, or other micro-fluidic pump device.

Further, as used in the present specification and in the appended claims, the term "nozzle" refers to an individual component of a fluid ejection die through which a fluid is dispensed onto a surface. The nozzle may be associated that at least one ejection chamber and an actuator used to force the fluid out of the ejection chamber through the opening of the nozzle.

Further, as used in the present specification and in the appended claims, the term "fluid printing cartridge" may refer to any device used in the ejection of fluids such as inks onto a print medium. In general, a printing fluid cartridge may be a fluidic ejection device that dispenses fluid such as ink, wax, polymers, biofluids, reactants, analytes, pharmaceuticals, or other fluids. A fluid printing cartridge may include at least one fluid ejection die. In some examples, a fluid printing cartridge may be used in printing devices, three-dimensional (3D) printing devices, graphic plotters, copiers, and facsimile machines, for example. In these examples, a fluid ejection die may eject ink, or another fluid, onto a print medium such as paper to form a desired image or otherwise place an amount of the fluid a digitally addressed portion of the print medium.

Further, as used in the present specification and in the appended claims, the term "length" refers to the longer or longest dimension of an object as depicted, whereas "width" refers to the shorter or shortest dimension of an object as depicted.

Even further, as used in the present specification and in the appended claims, the term "a number of" or similar language is meant to be understood broadly as any positive number including 1 to infinity.

Figure 1B:
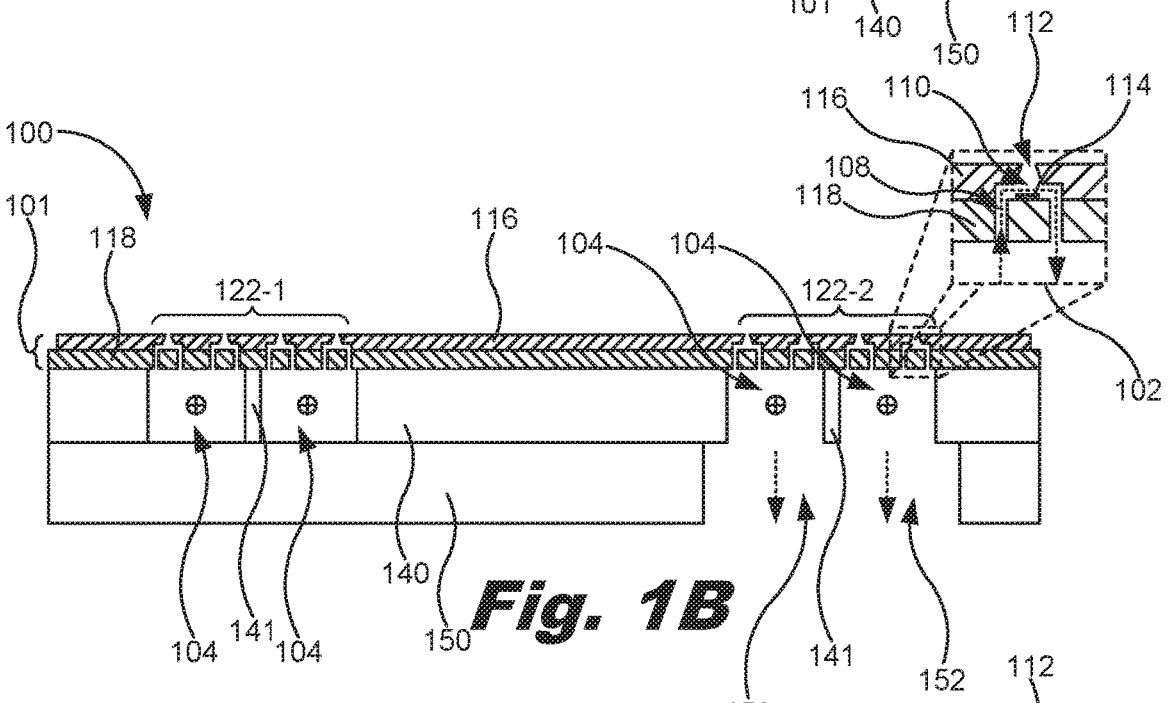
FIG. 1B is a cutaway view of the fluid flow structure of FIG. 1A along line A-A as depicted in FIG. 1A, according to an example of the principles described herein.
Figure 1C:
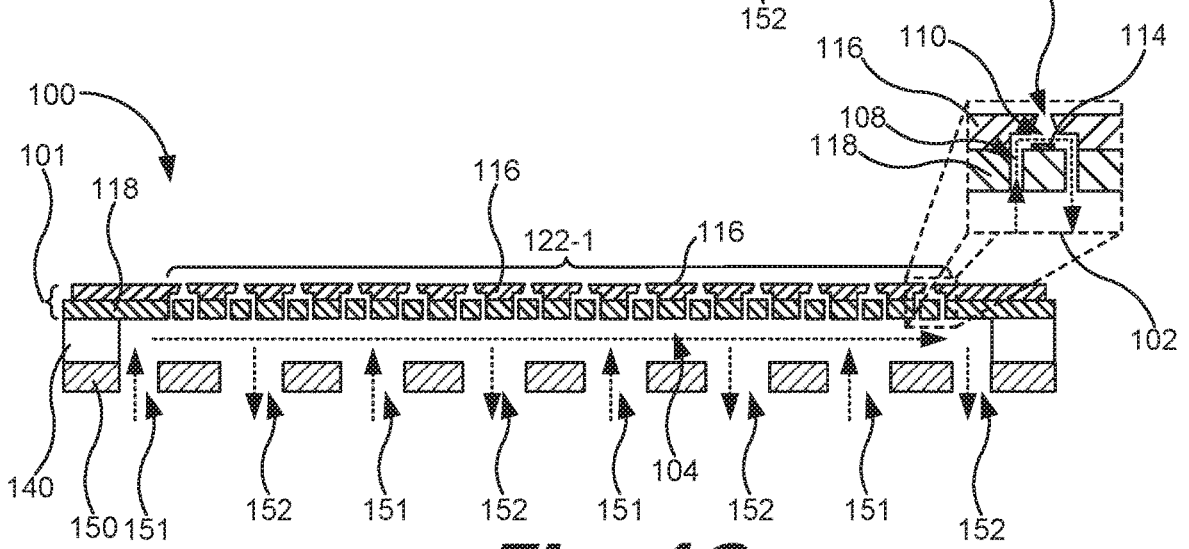
FIG. 1C is a cutaway view of the fluid flow structure of FIG. 1A along line B-B as depicted in FIG. 1A, according to an example of the principles described herein.

Turning now to the figures, FIGS. 1A-1C are views of a fluid ejection die (100) including a fluid ejection layer (101), a fluid channel layer (140) and an interposer layer (150), according to an example of the principles described herein. Specifically, FIG. 1A is a perspective view of a fluid flow structure referred to herein as the fluid ejection die (100), according to an example of the principles described herein. FIG. 1B is a cutaway view of the fluid ejection die (100) of FIG. 1A along line A-A as depicted in FIG. 1A, according to an example of the principles described herein. FIG. 1C is a cutaway view of the fluid ejection die (100) of FIG. 1A along line B-B as depicted in FIG. 1A, according to an example of the principles described herein.

To eject the fluid onto a substrate such as a printing medium, the fluid ejection die (100) includes an array of fluid ejection subassemblies (102). For simplicity in FIG. 1A, one fluid ejection subassembly (102), and, in particular, its nozzle aperture (122), has been indicated with a reference number in FIG. 1A. Moreover, it should be noted that the relative size of the fluid ejection subassemblies (102) and the fluid ejection die (100) are not to scale, with the fluid ejection subassemblies (102) being enlarged for purposes of illustration. The fluid ejection subassemblies (102) of the fluid ejection die (100) may be arranged in columns or arrays such that properly sequenced ejection of fluid from the fluid ejection subassemblies (102) causes characters, symbols, and/or other graphics or images to be printed on the print medium as the fluid ejection die (100) and print medium are moved relative to each other.

In one example, the fluid ejection subassemblies (102) in the array may be further grouped. For example, a first subset of fluid ejection subassemblies (102) of the array may pertain to one color of ink, or one type of fluid with a set of fluidic properties, while a second subset of fluid ejection subassemblies (102) of the array may pertain to another color of ink, or fluid with a different set of fluidic properties. The fluid ejection die (100) may be coupled to a controller that controls the fluid ejection die (100) in ejecting fluid from the fluid ejection subassemblies (102). For example, the controller defines a patter of ejected fluid drops that form characters, symbols, and/or other graphics or images on the print medium. The patter of ejected fluid drops is determined by the print job commands and/or command parameters received from a computing device.

FIGS. 1B and 1C are cross-sectional views of the fluid ejection die (100) along lines A-A and B-B respectively. The reference numbers 104 in FIGS. 1B and 1C refer to the enclosed cross-channel and not the fluid flow, which fluid flow indicated by the dashed arrows. Further, indicators of fluid flow into the figures or into the page are indicated by a circle with a cross in the middle while indicators of fluid flow out of the figures or out from the page (if present) are indicated by a circle with a dot in the middle. Further, arrows with heads on them as opposed to arrows without heads indicate voids or other negative spaces.

Among other things, FIGS. 1B and 1C depict a fluid ejection subassembly (102) of the array. For simplicity, one fluid ejection subassembly (102) in FIGS. 1B and 1C is indicated with a reference number. To eject fluid, the fluid ejection subassembly (102) includes a number of components. For example, a fluid ejection subassembly (102) may include an ejection chamber (110) to hold an amount of fluid to be ejected, a nozzle aperture (112) through which an amount of the fluid is ejected, and a fluid ejection actuator (114), disposed within the ejection chamber (110), to eject the amount of fluid through the nozzle aperture (112). The ejection chamber (110) and nozzle aperture (112) may be defined in a nozzle substrate (116) of the fluid ejection layer (101) that is deposited on top of a fluid feed hole substrate (118) of the fluid ejection layer (101). In some examples, the nozzle substrate (116) may be formed of SU-8 or other material.

Turning to the fluid ejection actuators (114), the fluid ejection actuator (114) may include a firing resistor or other thermal device, a piezoelectric element, or other mechanism for ejecting fluid from the ejection chamber (110). For example, the fluid ejection actuator (114) may be a firing resistor. The firing resistor heats up in response to an applied voltage. As the firing resistor heats up, a portion of the fluid in the ejection chamber (110) vaporizes to form a cavitation bubble. This cavitation bubble pushes fluid out the nozzle aperture (112) and onto the print medium. As the vaporized fluid bubble pops, fluid is drawn into the ejection chamber (110) from a fluid feed hole (108), and the process repeats. In this example, the fluid ejection die (100) may be a thermal inkjet (TIJ) fluid ejection die (100).

In another example, the fluid ejection actuator (114) may be a piezoelectric device. As a voltage is applied, the piezoelectric device changes shape which generates a pressure pulse in the ejection chamber (110) and pushes the fluid out the nozzle aperture (112) and onto the print medium. In this example, the fluid ejection die (100) may be a piezoelectric inkjet (PIJ) fluid ejection die (100).

The fluid ejection die (100) also includes a number of fluid feed holes (108) that are formed in a fluid feed hole substrate (118). The fluid feed holes (108) deliver fluid to and from the corresponding ejection chamber (110). In some examples, the fluid feed holes (108) are formed in a perforated membrane of the fluid feed hole substrate (118). For example, the fluid feed hole substrate (118) may be formed of silicon, and the fluid feed holes (108) may be formed in a perforated silicon membrane that forms part of the fluid feed hole substrate (118). That is, the membrane may be perforated with holes which, when joined with the nozzle substrate (116), align with the ejection chamber (110) to form paths of ingress and egress of fluid during the ejection process. As depicted in FIGS. 1B and 1C, two fluid feed holes (108) may correspond to each ejection chamber (110) such that one fluid feed hole (108) of the pair is an inlet to the ejection chamber (110) and the other fluid feed hole (108) is an outlet from the ejection chamber (110) as indicated by the arrows depicted in the projected window of these figures. In some examples, the fluid feed hole (108) may be round holes, square holes with rounded corners, or other type of passage.

The fluid ejection die (100) may also include a number of fluid channels (104) defined in the fluid channel layer (140). The fluid channels (104) are defined within the fluid channel layer (140) along a length of the fluid ejection device. The fluid channels (104) may be formed to fluidically interface with the backside of the fluid feed hole substrate (118) and deliver fluid to and from the fluid feed holes (108) defined within the fluid feed hole substrate (118). In one example, each fluid channel (104) is fluidically coupled to a number of fluid feed holes (108) of an array of fluid feed holes (108). That is, fluid enters a fluid channels (104), passes through the fluid channels (104), passes to respective fluid feed holes (108), and then exits the fluid feed holes (108) and into the fluid channel (104) to be mixed with other fluid in the associated fluidic delivery system. In some examples, the fluid path through the fluid channels (104) is perpendicular to the flow through the fluid feed holes (108) as indicated by the arrows. That is, fluid enters an inlet, passes through the fluid channel (104), passes to respective fluid feed holes (108), and then exits an outlet to be mixed with other fluid in the associated fluidic delivery system. The flow through the inlet, fluid channel (104) and outlet is indicated by arrows in FIGS. 1B and 1C.

The fluid channels (104) are defined by any number of surfaces. For example, one surface of a fluid channel (104) may be defined by the membrane portion of the fluid feed hole substrate (118) in which the fluid feed holes (108) are defined. Another surface may be at least partially defined by an interposer layer (150).

The individual fluid channels (104) of the array may correspond to fluid feed holes (108) and corresponding ejection chambers (110) of a particular row. For example, as depicted in FIG. 1A, the array of fluid ejection subassemblies (102) may be arranged in rows, and each fluid channel (104) may align with a row, such that fluid ejection subassemblies (102) in a row may share the same fluid channel (104). While FIG. 1A depicts the rows of fluid ejection subassemblies (102) in a straight line, the rows of fluid ejection subassemblies (102) may be angled, curved, chevron-shaped, staggered, or otherwise oriented or arranged.

Accordingly, in these examples, the fluid channels (104) may be similarly, angled, curved, chevron-shaped, or otherwise oriented or arranged to align with the arrangement of the fluid ejection subassemblies (102). In another example, the fluid feed holes (108) of a particular row may correspond to multiple fluid channels (104). That is, the rows may be straight, but the fluid channels (104) may be angled. While specific reference is made to a fluid channel (104) per two rows of fluid ejection subassemblies (102), more or fewer rows of fluid ejection subassemblies (102) may correspond to a single fluid channel (104).

Further, as depicted in FIGS. 1B and 1C, a plurality of fluid channels (104) may be separated by ribs (141). The ribs (141) may serve to support the layers above the fluid channel layer (140) including the nozzle substrate (116) and fluid feed hole substrate (118) of the fluid ejection layer (101). In one example, the ribs (141) extend between adjacent fluid channels (104) for the length of the fluid channels (104). In another example, the ribs (141) may be intermittent along the length of the fluid channels (104).

In some examples, the fluid channels (104) deliver fluid to rows of different subsets of the array of fluid feed holes (108). For example, as depicted in FIG. 1B, a plurality of fluid channels (104) may deliver fluid to a row of fluid ejection subassemblies (102) in a first subset (122-1) and a row of fluid ejection subassemblies (102) in a second subset (122-2). In this example, one type of fluid, for example, one ink of a first color, may be provided to a first subset (122-1) via its corresponding fluid channels (104) and an ink of a second color may be provided to a second subset (122-2) via its corresponding fluid channels (104). In a specific example, a mono-chrome fluid ejection die (100) may implement at least one fluid channel (104) across multiple subsets (122) of fluid ejection subassemblies (102). Such fluid ejection dies (100) may be used in multi-color printing fluid cartridges.

These fluid channels (104) promote increased fluid flow through the fluid ejection die (100). For example, without the fluid channels (104), fluid passing on a backside of the fluid ejection die (100) may not pass close enough to the fluid feed holes (108) to sufficiently mix with fluid passing through the fluid ejection subassemblies (102). However, the fluid channels (104) draw fluid closer to the fluid ejection subassemblies (102) thus facilitating greater fluid mixing. The increased fluid flow also improves nozzle health as used fluid is removed from the fluid ejection subassemblies (102), which used fluid, if recycled throughout the fluid ejection subassembly (102), can damage the fluid ejection subassembly (102).

Further, as cooler fluid is moved through the fluid channels (104), into the fluid feed holes (108), and back into the fluid channels (104), the cool fluid causes the fluid ejection actuator (114) to cool by pulling the heat from the fluid ejection actuator (114) through heat transfer. Thus, the fluid to be ejected by the fluid ejection subassemblies (102) serves also as a coolant to cool the fluid ejection actuators (114) within the fluid ejection die (100) and, in turn, cool the fluid ejection die (100) as a whole.

However, as the fluid passes over a first fluid ejection actuator (114) along the length of the fluid ejection die (100), the fluid is relatively hotter than when it was introduced to the first fluid ejection actuator (114). The fluid gets hotter and hotter as it is passed over consecutive first fluid ejection actuators (114). This causes the coolant effect of the fluid to become less and less effective as it moves down the rows of fluid ejection actuators (114) from one end of the fluid ejection die (100) to the other, and causes a heat gradient to be created along the length of the fluid ejection die (100) with a first end of the fluid ejection die (100) where the fluid is first introduced to the fluid channels (104) being relatively cooler than a second end of the fluid ejection die (100) where the fluid leaves the fluid channels (104). In order to reduce or eliminate this heat gradient in the fluid ejection die (100), an interposer layer (150) may be included adjacent the fluid channel layer (140) on an opposite side of the fluid channel layer (140) relative to the fluid ejection layer (101).

The interposer layer (150) may include a number of inlet ports (151) and outlet ports (152). In one example, the inlet ports (151) and outlet ports (152) may be spaced at approximately 3.8 millimeter (mm) pitch. The sizes, numbers, and positions of the inlet ports (151) and outlet ports (152) defined in the interposer layer (150) may be based on a desired velocity of flow of fluid within the fluid channels (104) and may take into account optimizing pressures within the fluid channels (104). Thus, any number of inlet ports (151) and outlet ports (152) may be defined within the interposer layer (150). Further, the dimensions of the inlet ports (151) and outlet ports (152) may vary among one another to optimize any localized pressures within the fluid channels (104). Thus, the dimensions of the inlet ports (151) and outlet ports (152) and the pressure of fluids provided to each of the inlet ports (151) and outlet ports (152) may be different from each other to allow for design optimization.

The inlet ports (151) and outlet ports (152) serve to manage pressure drops that may otherwise occur through the fluid channels (104) given that the fluid channels (104) extend through a major portion of the length of the fluid ejection die (100). In one example, the thickness and width of the fluidic channels (104) may be increased or decreased to minimize any pressure drop within the fluidic channels (104).

Further, the inlet ports (151) and outlet ports (152) serve to provide fresh, cool fluid to the fluid channels (104) and the fluid ejection layer (101) such that any temperature gradient that may otherwise exist along the length of the fluid ejection die (100) may be reduced or eliminated. In one example, a number of external pumps may be fluidically coupled to the fluid channels (104), the inlet ports (151), and the outlet ports (152). The external pumps cause fluid to flow into and out of the inlet ports (151) and the outlet ports (152) as well as into and out of the fluid channels (104) as indicated by the fluid flow arrows. With cool fluid constantly flowing into the inlet ports (151), the fluid channels (104), and the fluid feed holes (108) and ejection chambers (110) of the fluid ejection subassemblies (102), fresh cool fluid is made available to the fluid ejection layer (101). Further, by pulling fluid heated by the fluid ejection actuators (114) of the fluid ejection subassemblies (102) out from the fluid ejection layer (101) and the fluid channels (104) using the outlet ports (152), heat is continually removed from the system, and any heat gradients are not formed along the fluid ejection die (100).

In one example, while the figures depict straight fluid channel (104), inlet port (151), and outlet port (152) sidewalls, in some examples, the sidewalls may include uneven or non-linear sidewalls such as zig-zag sidewalls. Further, posts, or other structures may be included to create turbulent flow in the microchannel and encourage the coupling of micro-recirculation of fluid through the fluid feed hole (108) to macro-recirculation of fluid through the fluid channels (104), inlet ports (151), and outlet ports (152).

In one example, a number of internal pumps may be used to move the fluid through the micro-recirculation channels including the fluid feed hole (108) and the ejection chambers (110) as well as the relatively larger macro-recirculation channels such as the fluid channels (104), inlet ports (151), and outlet ports (152). These internal pumps may take the form of a recirculation pump, which is an example of a non-ejecting actuator that moves fluid through passages, channels, and other pathways within the fluid ejection die (100). The recirculation pumps may be any resistive device, piezoelectric device, or other micro-fluidic pump device.

Figure 2:
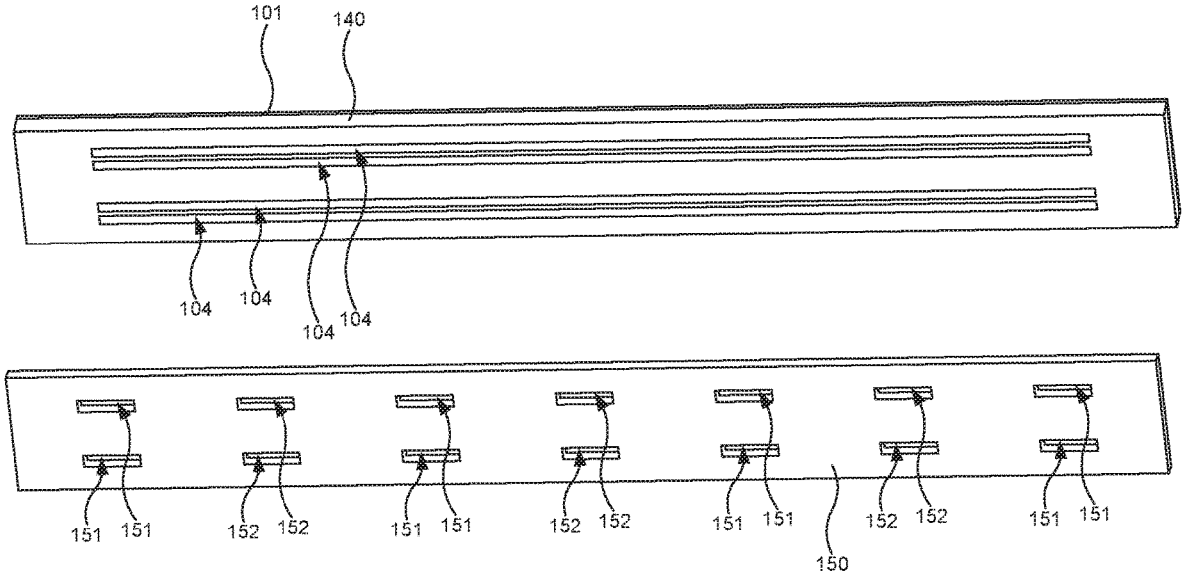
FIG. 2 is an exploded view of the fluid flow structure of FIG. 1A, according to an example of the principles described herein.

FIG. 2 is an exploded view of the fluid ejection die (100) of FIG. 1A, according to an example of the principles described herein. Using any manufacturing process, the fluid ejection layer (101) is coupled to the fluid channel layer (140) so as to align the fluid channels (104) defined within the fluid channel layer (140) with a number of fluid ejection subassemblies (102) of the fluid ejection layer (101). The interposer layer (150) is aligned with the fluid channel layer (140) such that the inlet ports (151) and outlet ports (152) defined in the interposer layer (150) are aligned with the fluid channels (104) defined within the fluid channel layer (140).

Figure 3:
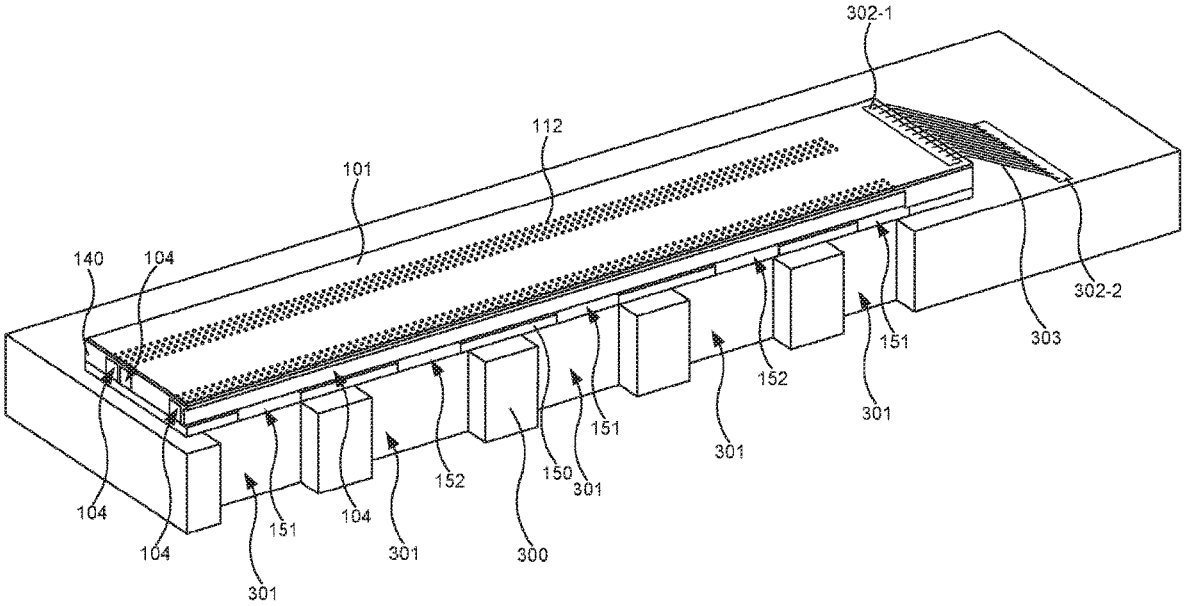
FIG. 3 is an isometric view of the fluid flow structure of FIG. 1A coupled to a carrier, according to an example of the principles described herein.

FIG. 3 is an isometric view of the fluid ejection die (100) of FIG. 1A coupled to a carrier substrate (300), according to an example of the principles described herein. The carrier substrate (300) may include a number of carrier apertures (301) defined therein that align with the inlet ports (151) and outlet ports (152) defined in the interposer layer (150). Further, a number of electrical contact pads (302-1, 302-2) may be included on the fluid ejection die (100) and the carrier substrate (300), respectively. A number of electrical traces (303) may electrically couple the electrical contact pads (302-1, 302-2) to one another. The electrical contact pads (302-1, 302-2) and electrical traces (303) serve to provide activation pulses to the fluid ejection actuators (114) of the fluid ejection subassemblies (102) so that fluid may be dispensed as instructed by a control device.

In one example, at least a portion of the fluid ejection die (100) may be overmolded within a moldable material. In one example, the moldable material may be molded over all sides of the fluid ejection die (100) except an ejection side of the fluid ejection layer (101). Further, the moldable material may be molded over the electrical contact pads (302-1, 302-2) and electrical traces (303) to protect these elements from coming into contact with the environment or other elements or forces. The moldable material may also cover portions of the fluid ejection die (100) and the carrier substrate (300) except the fluid channels (104) and inlet ports (151) and outlet ports (152) defined in the fluid ejection layer (101) and the carrier apertures (301) defined in the carrier substrate (300).

Figure 4:
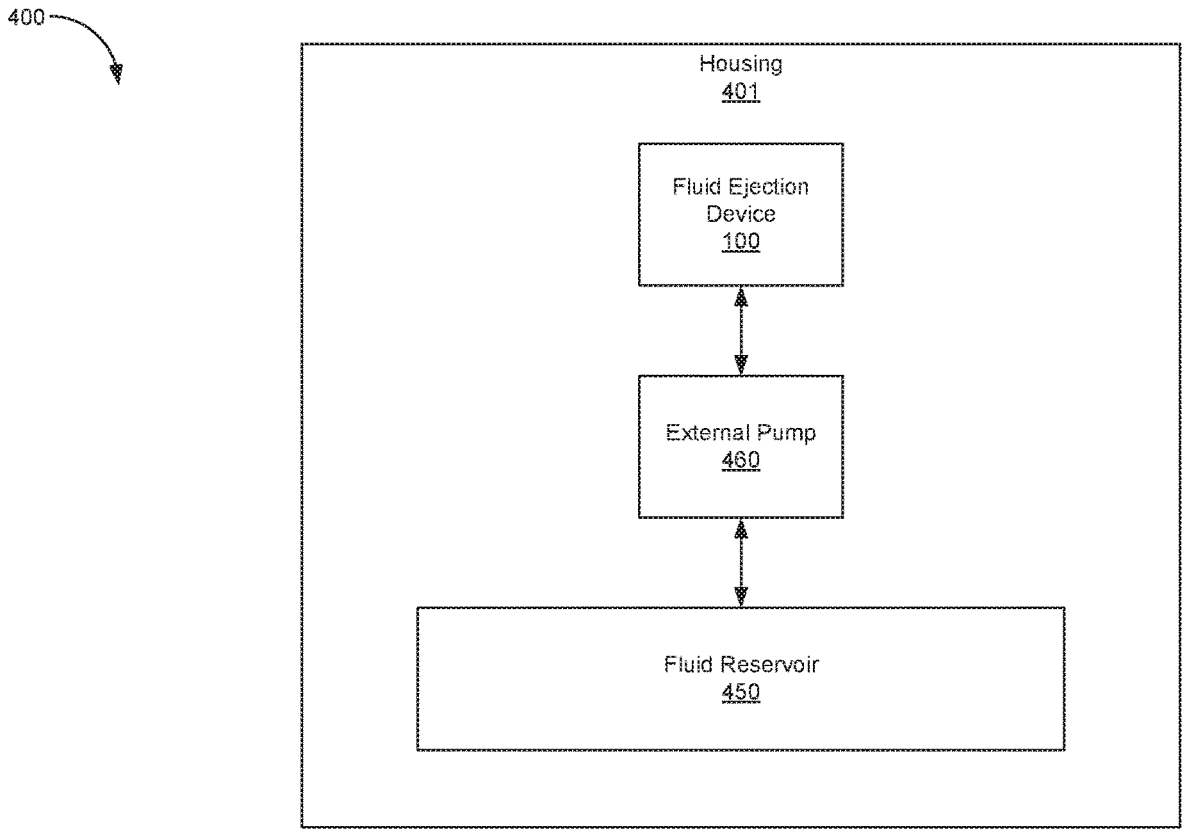
FIG. 4 is a block diagram of a printing fluid cartridge including the fluid flow structure of FIG. 1A, according to an example of the principles described herein.

FIG. 4 is a block diagram of a printing fluid cartridge (400) including the fluid ejection die (100) of FIG. 1A, according to an example of the principles described herein. The printing fluid cartridge (400) may be any system for recirculating fluid with the fluid ejection die (100), and may include a housing (401) to house at least one fluid ejection die (100). The housing (401) may also house a fluid reservoir (450) fluidically coupled to the fluid ejection die (100), and provides fluid to the fluid ejection die (100).

A number of external pumps (460) may be located inside and/or outside the housing (401). The external pumps (460, 470), coupled to the fluid reservoir (450), serve to pump fluid into and out of the fluid ejection die (100) as the fluid moves into and out of the fluid channels (104) and inlet (151) and outlet (152) ports by exerting a pressure difference sufficient to move the fluid through the fluid channels (104) and inlet (151) and outlet (152) ports.

Figure 5:
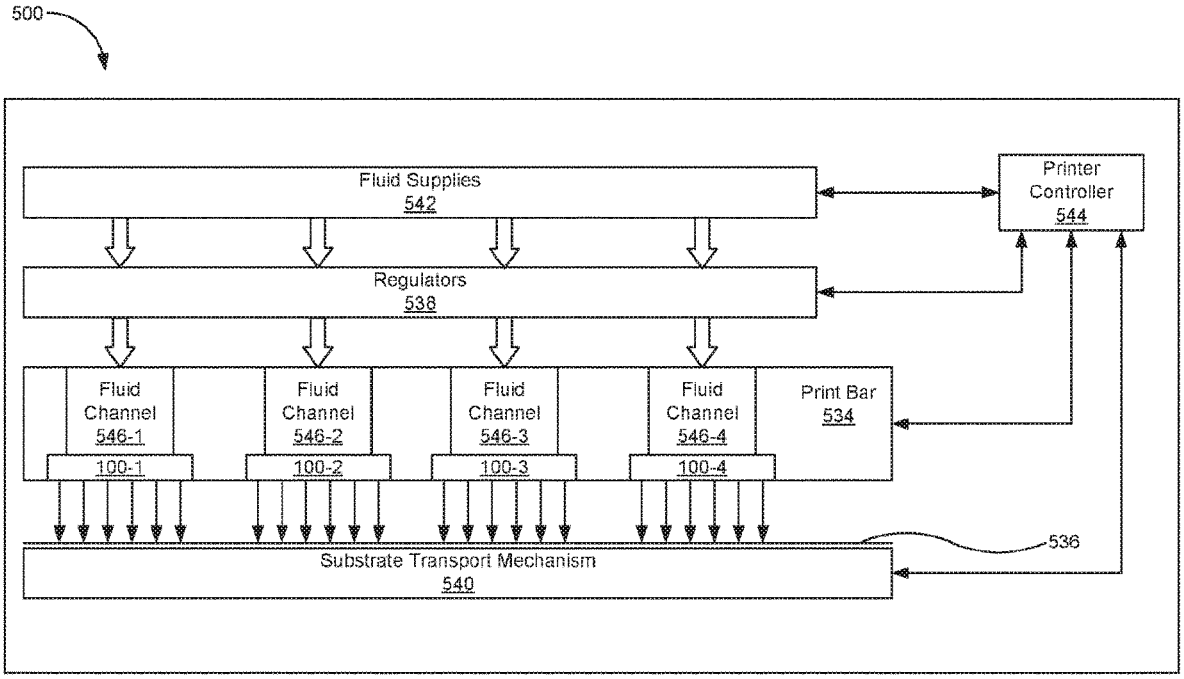
FIG. 5 is a block diagram of a printing device including a number of fluid flow structure in a substrate wide print bar, according to an example of the principles described herein.

FIG. 5 is a block diagram of a printing device (500) including a number of fluid ejection die (100) in a substrate wide print bar, according to an example of the principles described herein. The printing device (500) may include a print bar (534) spanning the width of a print substrate (536), a number of flow regulators (538) associated with the print bar (534), a substrate transport mechanism (540), printing fluid supplies (542) such as a fluid reservoir (FIG. 4, 450), and a controller (544). The controller (544) represents the programming, processor(s), and associated memories, along with other electronic circuitry and components that control the operative elements of the printing device (500). The print bar (534) may include an arrangement of fluidic ejection dies (100) for dispensing fluid onto a sheet or continuous web of paper or other print substrate (536). Each fluid ejection die (100) receives fluid through a flow path that extends from the fluid supplies (542) into and through the flow regulators (538), and through a number of transfer molded fluid channels (546) defined in the print bar (534).

Figure 6:
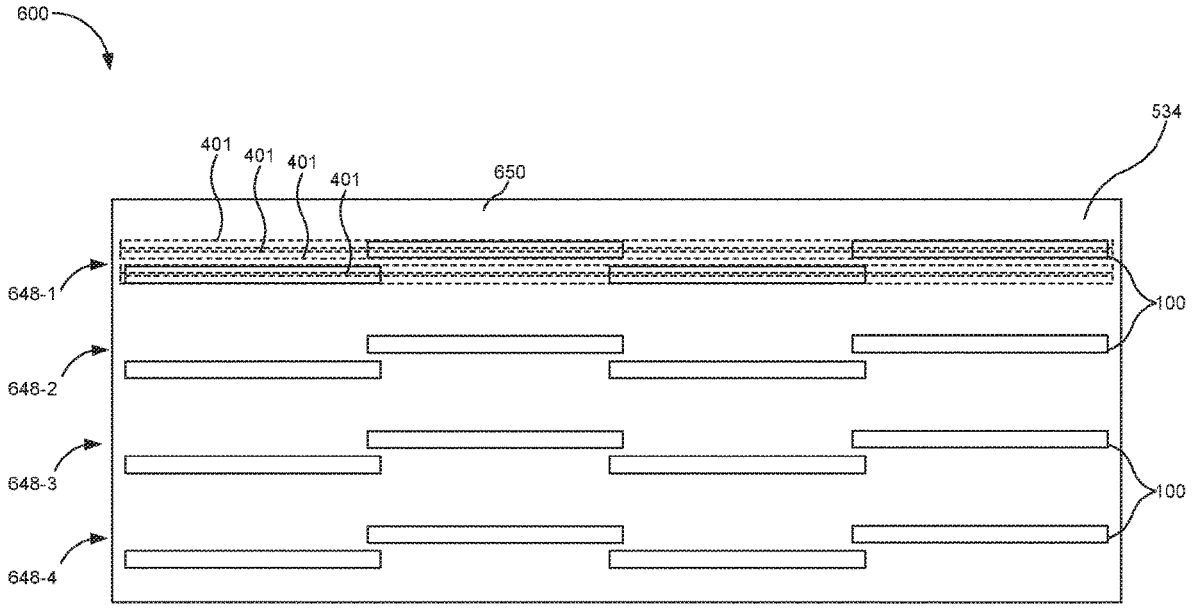
FIG. 6 is a block diagram of a print bar including a number of fluid flow structures, according to an example of the principles described herein.

FIG. 6 is a block diagram of a print bar (600) including a number of fluid ejection die (100), according to an example of the principles described herein. In some examples, the fluid ejection dies (100) are embedded in an elongated, monolithic molding (650) as described above. The fluid ejection dies (100) are arranged end to end in a number of rows (648-1, 648-2, 648-3, 648-4, collectively referred to herein as 648). In one example, the fluid ejection dies (100) may be arranged in a staggered configuration in which the fluid ejection dies (100) in each row (648) overlap another fluid ejection die (100) in that same row (648). In this arrangement, each row (648) of fluid ejection dies (100) receives fluid from at least one fluid channel (104) as illustrated with dashed lines in FIG. 6. FIG. 6 depicts four fluid channels (104) feeding a first row (648-1) of staggered fluid ejection dies (100). However, each row (648) may each include at least one fluid channel (104). In one example, the print bar (600) may be designed for printing four different colors of fluid or ink such as cyan, magenta, yellow, and black. In this example, different colors of fluid may be dispensed or pumped into the individual fluid channels (104).

Figure 7:
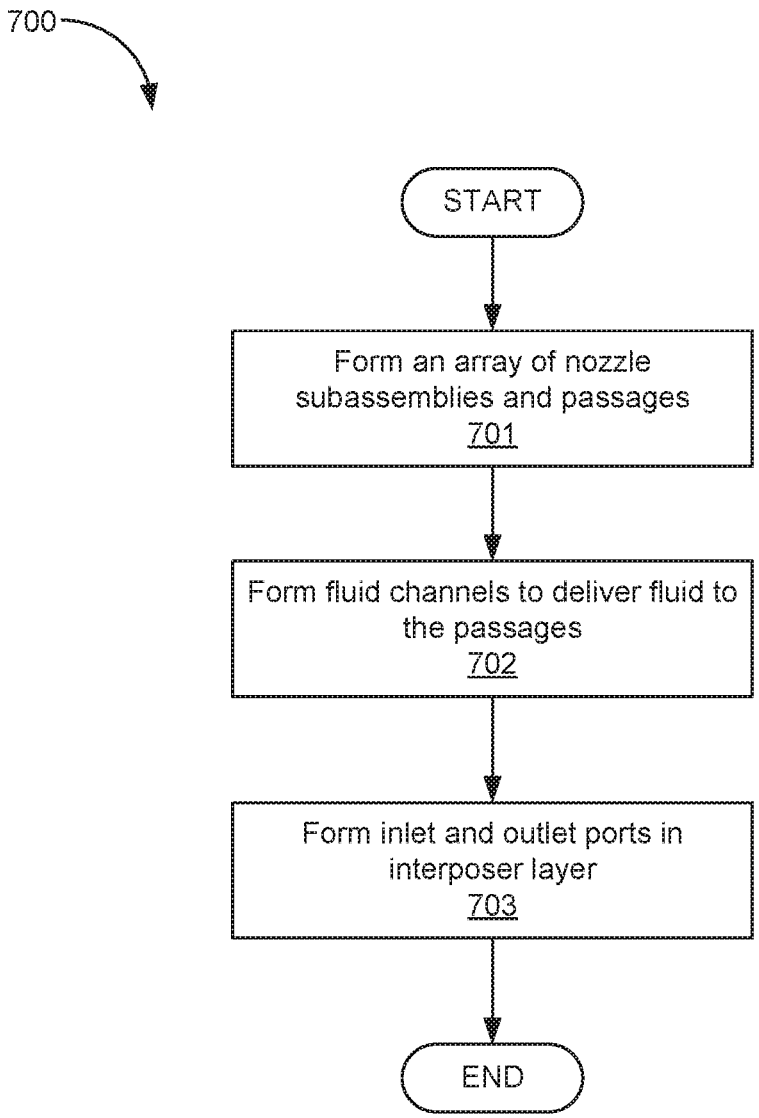
FIG. 7 is a flowchart of a method for forming a fluid flow structure, according to an example of the principles described herein.

FIG. 7 is a flowchart of a method (700) for forming a fluid ejection die (100), according to an example of the principles described herein. According to the method (700), an array of nozzle subassemblies (FIG. 1, 102) and fluid feed holes (FIG. 1, 108) may be formed (block 701) to create the fluid ejection layer (101). In some examples, the fluid feed holes (FIG. 1, 108) may be part of a perforated silicon membrane. The nozzle subassemblies (FIG. 1, 102), or rather the nozzle apertures (FIG. 1, 112) and the ejection chambers (FIG. 1, 110) of the nozzle subassemblies (FIG. 1, 102), may be defined in a nozzle substrate (FIG. 1, 116) such as SU-8. Accordingly, forming (block 701) the array of nozzle subassemblies (FIG. 1, 102) including the fluid feed holes (FIG. 1, 108) may include joining the perforated silicon membrane with the SU-8 nozzle substrate (FIG. 1, 116).

A number of fluid channels (FIG. 1, 104) may be formed (block 702). Forming (block 702) the fluid channels (FIG. 1, 104) may include transfer molding processes, material deposition processes, or material ablation processes, among other manufacturing processes. With the fluid channels (FIG. 1, 104) formed in the channel layer (140), and the nozzle subassemblies (FIG. 1, 102) formed in the fluid ejection layer (101), a number of inlet (151) and outlet (152) ports may be formed (block 703) in the interposer layer (150). The fluid ejection layer (101), fluid channel layer (140), and interposer layer (150) may be coupled together or formed using a number of material deposition or ablation steps to form the fluid ejection die (100) as depicted in FIGS. 1A through 1C.

The specification and figures describe a fluidic die that includes a fluid channel layer including at least one fluid channel defined along a length of the fluid ejection device. The fluidic die also includes an interposer layer coupled to the fluid channel layer. The interposer layer includes a number of inlet ports defined in the interposer layer to fluidically couple the at least one channel layer to a fluid source, and a number of outlet ports defined in the interposer layer to fluidically couple the at least one channel layer to the fluid source.

Using such a fluid ejection die 1) reduces the likelihood of nozzle capping and reducing or eliminating a decapping process by maintaining water concentration in the fluid, 2) facilitates more efficient micro-recirculation to the firing chambers and nozzles, 3) improves nozzle health, 4) provides fluid mixing near the die to increase print quality, and 5) convectively cools the fluid ejection die, among others. It is contemplated that the devices disclosed herein may address other matters and deficiencies in a number of technical areas. Thus, the fluid ejection die offers the full benefit of a printhead die architecture described herein and, at same time, addresses the pigment setting and thermal defect issues.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die comprising: a number of fluid ejectors arranged along a length of the fluidic die; a fluid channel layer comprising at least one fluid channel defined along the length of the fluidic die, the fluid channels to deliver fluid to the fluid ejectors; an interposer layer coupled to the fluid channel layer comprising: a number of inlet ports defined in the interposer layer to fluidically couple the at least one channel layer to a fluid source; a number of outlet ports defined in the interposer layer to fluidically couple the at least one channel layer to the fluid source; wherein along a first fluid channel in the fluid channel layer, the interposer layer comprises both inlet and outlet ports communicating with the first fluid channel, wherein the inlet ports and outlet ports are alternatingly arranged along the length of the fluidic die; and a number of internal pumps to provide micro-recirculation of the fluid into and out of the fluid ejectors and macro-recirculation of the fluid within the first fluid channel, inlet ports and outlet ports.

2. The fluidic die of claim 1, wherein the number of inlet ports and outlet ports defined in the interposer layer are spaced at a 3.8 mm pitch.

3. The fluidic die of claim 1, comprising a carrier substrate coupled to the interposer layer, the carrier substrate comprising a number of apertures defined therein corresponding to the inlet ports and outlet ports.

4. The fluidic die of claim 1, wherein:

the at least one fluid channel defined along a length of the fluidic die comprises at least two fluid channels, the at least two fluid channels separated by a rib therebetween, and the rib running the length of the two fluid channels or being intermittent along the length of the two fluid channels.

5. The fluidic die of claim 1, comprising a number of microfluidic pumps disposed to circulate fluid into and out of the fluidic die via the inlet and outlet ports of the interposer layer respectively.

6. The fluidic die of claim 1, wherein flow of a fluid within the at least one fluid channel is perpendicular relative to the flow of the fluid within the inlet ports and outlet ports.

7. The fluidic die of claim 1, wherein each fluid ejector of the fluidic die comprises two fluid feed holes, a first feed hole to accept fluid from, and a second feed hole to return fluid to, a same one of the fluid channels of the fluid channel layer.

8. The fluidic die of claim 1, wherein at least a portion of the fluidic die is overmolded within a moldable material.

9. The fluidic die of claim 1, wherein the interposer layer comprises alternating inlet and outlet ports along the first fluid channel, each inlet port being followed by an adjacent outlet port along a length of the first fluid channel.

10. The fluidic die of claim 1, wherein:

the number of fluid ejectors includes multiple fluid ejectors arranged side-by-side across a width of the fluidic die perpendicular to the length of the fluidic die; and a fluid channel of the fluid channel layer spans and is in fluid communication with multiple fluid ejectors arranged side-by-side across a width of the fluidic die.

11. The fluidic die of claim 10, wherein the fluid channel layer comprises a rib between a pair of fluid channels that communicate with adjacent fluid ejectors spaced apart from a second group of adjacent fluid ejectors of the fluidic die.

12. The fluidic die of claim 1, wherein adjacent channels in the fluid channel layer are configured to carry fluid in a same direction along the length of the fluidic die.

13. The fluidic die of claim 1, wherein the fluid channel layer comprises a rib between a pair of fluid channels that communicate with adjacent fluid ejectors spaced apart from a second group of adjacent fluid ejectors of the fluidic die.

14. A system for recirculating fluid within a fluidic die, comprising: a fluid reservoir; a fluidic the fluidically coupled to the fluid reservoir, the fluidic die comprising: a fluid channel layer comprising at least one fluid channel defined along a length of the fluidic the in fluid communication with an array of fluid ejectors also arranged along the length of the fluid die; an interposer layer coupled to the fluid channel layer comprising: a plurality of inlet ports defined in the interposer layer to fluidically couple the at least one channel layer to a fluid source; a plurality of outlet ports defined in the interposer layer to fluidically couple fluid that is output from the at least one channel layer to the fluid source; and a number of internal pumps to provide micro-recirculation of the fluid into and out of the fluid ejectors and macro-recirculation of the fluid within the at least one fluid channel, inlet ports and outlet ports; wherein along a first fluid channel in the fluid channel layer, the interposer layer comprises both inlet and outlet ports communicating with the first fluid channel, wherein the inlet ports and outlet ports are alternatingly arranged along the length of the fluidic die; and an external pump fluidically coupled to the fluid reservoir and the fluidic die to exert a pressure difference sufficient to move a fluid through the inlet ports and outlet ports.

15. The system of claim 14, wherein the fluid ejection die comprises:

a fluid ejection die fluidically coupled to the fluid channel layer via a number of fluid feed holes defined within the fluid ejection die, the fluid ejection die comprising:

a number of nozzles; and an array of fluid firing chambers fluidically coupled to the nozzles to eject fluid through the nozzles, wherein the number of fluid feed holes are fluidically coupled to the array of firing chambers.

16. The system of claim 14, comprising a carrier substrate coupled to the interposer layer, the carrier substrate comprising a number of apertures defined therein corresponding to the inlet ports and outlet ports.

17. A fluid flow structure comprising: a fluid channel layer comprising at least one fluid channel, including a first fluid channel, defined along a length of the fluid flow structure in fluid communication with an array of fluid ejectors also arranged along the length of the fluid flow structure; an interposer layer coupled to the fluid channel layer comprising: a plurality of inlet ports defined in the interposer layer to fluidically couple the first fluid channel to a fluid source; and a plurality of outlet ports defined in the interposer layer to fluidically couple fluid that is output from the same first fluid channel to the fluid source, wherein the inlet ports and outlet ports are alternatingly arranged along the length of the fluid flow structure; wherein each inlet or outlet port has a width along the length of the first channel that is less than a width of two adjacent fluid ejectors spaced along the length of the first channel so as to reduce a heat gradient from developing along a length of the first fluid channel.

18. The fluid flow structure of claim 17, comprising a carrier substrate coupled to the interposer layer, the carrier substrate comprising a number of apertures defined therein corresponding to the inlet ports and outlet ports.

19. The fluid flow structure of claim 17, wherein the number of inlet ports and outlet ports defined in the interposer layer are spaced at a 3.8 mm pitch.

20. The fluid flow structure of claim 17, wherein the fluid channel layer and interposer layer are at least partially overmolded within a moldable material.

* * * * *